US009688930B2

(12) United States Patent
Green et al.

(10) Patent No.: US 9,688,930 B2
(45) Date of Patent: Jun. 27, 2017

(54) DISTILLABLE FUEL MARKERS

(71) Applicants: ANGUS CHEMICAL COMPANY, Buffalo Grove, IL (US); DOW GLOBAL TECHNOLOGIES LLC, Midland, MI (US)

(72) Inventors: George David Green, Cary, IL (US); Raymond J. Swedo, Mount Prospect, IL (US); Ronda L. Gras, Edmonton (CA); Jim C. Luong, Sherwood Park (CA)

(73) Assignee: Dow Global Technologies LLC, Midland, MI (US)

( * ) Notice: Subject to any disclaimer, the term of this patent is extended or adjusted under 35 U.S.C. 154(b) by 51 days.

(21) Appl. No.: 14/441,202

(22) PCT Filed: Nov. 5, 2013

(86) PCT No.: PCT/US2013/068476

§ 371 (c)(1),
(2) Date: May 7, 2015

(87) PCT Pub. No.: WO2014/081556

PCT Pub. Date: May 30, 2014

(65) Prior Publication Data

US 2015/0307795 A1 Oct. 29, 2015

Related U.S. Application Data

(60) Provisional application No. 61/728,312, filed on Nov. 20, 2012.

(51) Int. Cl.

| | |
|---|---|
| ***C10L 1/18*** | (2006.01) |
| ***C10L 10/00*** | (2006.01) |
| ***C10L 1/00*** | (2006.01) |
| ***C10L 1/185*** | (2006.01) |

(52) U.S. Cl.

CPC ..... *C10L 1/18* (2013.01); *C10L 1/003* (2013.01); *C10L 1/1852* (2013.01); *C10L 10/00* (2013.01); *C10L 2200/0446* (2013.01); *C10L 2230/02* (2013.01); *C10L 2230/16* (2013.01); *C10L 2270/026* (2013.01)

(58) Field of Classification Search

USPC ..... 44/442, 447

See application file for complete search history.

(56) References Cited

U.S. PATENT DOCUMENTS

| | | | | |
|---|---|---|---|---|
| 5,981,283 | A | 11/1999 | Anderson, II et al. | |
| 7,858,373 | B2 | 12/2010 | Banavali et al. | |
| 2014/0142083 | A1* | 5/2014 | Kuntz | C07D 213/64 514/210.2 |

FOREIGN PATENT DOCUMENTS

| | | | |
|---|---|---|---|
| EP | 512404 | A1 | 11/1992 |
| WO | 2011032857 | A2 | 3/2011 |
| WO | WO2011032857 | * | 3/2011 |
| WO | 2012107454 | A1 | 8/2012 |

OTHER PUBLICATIONS

WO2011032857—Description Translated; Attlesey et al.; Mar. 2011.*

* cited by examiner

*Primary Examiner* — Prem C Singh
*Assistant Examiner* — Chantel Graham
(74) *Attorney, Agent, or Firm* — Kenneth Crimaldi

(57) ABSTRACT

A method for marking a petroleum hydrocarbon or a liquid biologically derived fuel by adding to the petroleum hydrocarbon or liquid biologically derived fuel at least one compound having formula $Ar(R^2)_m(OR^1)_n$, wherein Ar is an aromatic ring system having from six to twenty carbon atoms, $R^1$ is $C_1$-$C_{12}$ alkyl or $C_2$-$C_{12}$ alkenyl, $R^2$ is $C_1$-$C_{12}$ alkyl or $C_3$-$C_{12}$ alkenyl, m is an integer from zero to five and n is an integer from one to three; wherein each compound of formula $Ar(R^2)_m(OR^1)_n$ is present at a level from 0.01 ppm to 100 ppm.

12 Claims, No Drawings

DISTILLABLE FUEL MARKERS

This invention relates to new compounds useful in a method for marking liquid hydrocarbons and other fuels and oils.

Marking of petroleum hydrocarbons and other fuels and oils with various kinds of chemical markers is well known in the art. A variety of compounds have been used for this purpose, as well as numerous techniques for detection of the markers, e.g., absorption spectroscopy and mass spectrometry. For example, U.S. Pat. No. 7,858,373 discloses the use of a variety of organic compounds for use in marking liquid hydrocarbons and other fuels and oils. Combinations of markers can be used as digital marking systems, with the ratios of amounts forming a code for the marked product. Additional compounds useful as fuel and lubricant markers would be desirable to maximize the available codes. There also is a need for additional marker compounds for these products which are difficult to remove by distillation of the marked fuel. The problem addressed by this invention is to find additional markers useful for marking liquid hydrocarbons and other fuels and oils.

STATEMENT OF INVENTION

The present invention provides a method for marking a petroleum hydrocarbon or a liquid biologically derived fuel; said method comprising adding to said petroleum hydrocarbon or liquid biologically derived fuel at least one compound having formula $Ar(R^2)_m(OR^1)_n$, wherein Ar is an aromatic ring system having from six to twenty carbon atoms, $R^1$ is $C_1$-$C_{12}$ alkyl or $C_2$-$C_{12}$ alkenyl, $R^2$ is $C_1$-$C_{12}$ alkyl or $C_3$-$C_{12}$ alkenyl, m is an integer from zero to five and n is an integer from one to three; wherein each compound of formula $Ar(R^2)_m(OR^1)_n$ is present at a level from 0.01 ppm to 100 ppm.

DETAILED DESCRIPTION

Percentages are weight percentages (wt %) and temperatures are in ° C., unless specified otherwise. Boiling points mentioned herein are measured at atmospheric pressure. Concentrations are expressed either in parts per million ("ppm") calculated on a weight/weight basis, or on a weight/volume basis (mg/L); preferably on a weight/volume basis. The term "petroleum hydrocarbon" refers to products having a predominantly hydrocarbon composition, although they may contain minor amounts of oxygen, nitrogen, sulfur or phosphorus; petroleum hydrocarbons include crude oils as well as products derived from petroleum refining processes; they include, for example, crude oil, lubricating oil, hydraulic fluid, brake fluid, gasoline, diesel fuel, kerosene, jet fuel and heating oil. Marker compounds of this invention can be added to a petroleum hydrocarbon or a liquid biologically derived fuel; examples of the latter are biodiesel fuel, ethanol, butanol, ethyl tert-butyl ether or mixtures thereof. A substance is considered a liquid if it is in the liquid state at 20° C. A biodiesel fuel is a biologically derived fuel containing a mixture of fatty acid alkyl esters, especially methyl esters. Biodiesel fuel typically is produced by transesterification of either virgin or recycled vegetable oils, although animal fats may also be used. An ethanol fuel is any fuel containing ethanol, in pure form, or mixed with petroleum hydrocarbons, e.g., "gasohol." An "alkyl" group is a substituted or unsubstituted saturated hydrocarbyl group having from one to twenty-two carbon atoms in a linear, branched or cyclic arrangement. Substitution on alkyl groups of one or more OH or alkoxy groups is permitted; other groups may be permitted when specified elsewhere herein. Preferably, alkyl groups are unsubstituted. Preferably, alkyl groups are linear or branched. An "alkenyl" group is an alkyl group having at least one carbon-carbon double bond. Preferably, alkenyl groups have one or two carbon-carbon double bonds, preferably one. An "aryl" group is a substituent derived from an aromatic hydrocarbon compound. An aryl group has a total of from six to twenty ring atoms, unless otherwise specified, and has one or more rings which are separate or fused. Preferably, the compounds of this invention contain elements in their naturally occurring isotopic proportions.

Preferably, $R^1$ is linear or branched. Preferably, $R^2$ is linear or branched Preferably, $R^1$ is $C_4$-$C_{12}$ alkyl or $C_4$-$C_{12}$ alkenyl, preferably $C_4$-$C_{12}$ alkyl, preferably $C_4$-$C_{10}$ alkyl. Preferably, $R^2$ is $C_1$-$C_6$ alkyl or $C_3$-$C_6$ alkenyl, preferably $C_1$-$C_6$ alkyl, preferably $C_1$-$C_4$ alkyl, preferably methyl or ethyl. Preferably, n is one or two, preferably one. Preferably, m is from zero to two, preferably zero or one, preferably zero. Preferably, Ar represents a benzene ring system and the compound of formula $Ar(R^2)_m(OR^1)_n$ is described by formula (I)

(I)

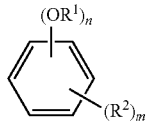

Preferably, in formula (I), $R^1$ is $C_4$-$C_{12}$ alkyl or $C_4$-$C_{12}$ alkenyl, preferably $C_4$-$C_{12}$ alkyl, preferably $C_4$-$C_{10}$ alkyl; preferably $R^2$ is $C_1$-$C_6$ alkyl or $C_3$-$C_6$ alkenyl, preferably $C_1$-$C_6$ alkyl, preferably $C_1$-$C_4$ alkyl, preferably methyl or ethyl. Preferably, in formula (I), m is from zero to two, preferably zero or one, preferably zero; preferably, n is one or two, preferably one. In one preferred embodiment, in formula (I), n is two or three, $R^1$ is methyl, $R^2$ is methyl or is absent (m=0) and m is zero or one; preferably n is two or three, $R^1$ is methyl and m is zero.

In one preferred embodiment, the compound of formula $Ar(R^2)_m(OR^1)_n$ is described by formula (II)

(II)

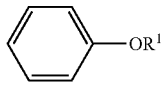

in which $R^1$ is $C_4$-$C_{12}$ alkyl or $C_4$-$C_{12}$ alkenyl, preferably $C_4$-$C_{12}$ alkyl, preferably $C_4$-$C_{10}$ alkyl.

In one preferred embodiment, Ar has from 10 to 12 carbon atoms, n is one or two, $R^1$ is methyl, $R^2$ is methyl or is absent (m=0) and m is zero or one; preferably Ar is a substituted (substituted only by —$OR^1$) biphenyl or naphthalene, n is one or two, $R^1$ is methyl and m is zero.

In using the compounds of this invention as markers, preferably the minimum amount of each compound added to a liquid to be marked is at least 0.05 ppm, preferably at least 0.1 ppm, preferably at least 0.2 ppm, preferably at least 0.3 ppm, preferably at least 0.4 ppm, preferably at least 0.5 ppm, preferably at least 1 ppm. Preferably, the maximum amount of each marker is 50 ppm, preferably 20 ppm, preferably 15 ppm, preferably 10 ppm, preferably 8 ppm. Preferably, the maximum total amount of marker compounds is 100 ppm, preferably 70 ppm, preferably 60 ppm, preferably 50 ppm, preferably 40 ppm, preferably 30 ppm, preferably 20 ppm, preferably 16 ppm, preferably 12 ppm, preferably 10 ppm. Preferably, a marker compound is not detectable by visual means in the marked petroleum hydrocarbon or liquid biologically derived fuel, i.e., it is not possible to determine by unaided visual observation of color or other characteristics that it contains a marker compound. Preferably, a marker compound is one that does not occur normally in the petroleum hydrocarbon or liquid biologically derived fuel to which it is added, either as a constituent of the petroleum hydrocarbon or liquid biologically derived fuel itself, or as an additive used therein.

Preferably, the marker compounds have a log P value of at least 3, where P is the 1-octanol/water partition coefficient. Preferably, the marker compounds have a log P of at least 4, preferably at least 5. Log P values which have not been experimentally determined and reported in the literature can be estimated using the method disclosed in Meylan, W. M & Howard, P. H., *J. Pharm. Sci.*, vol. 84, pp. 83-92 (1995). Preferably the petroleum hydrocarbon or liquid biologically derived fuel is a petroleum hydrocarbon, biodiesel fuel or ethanol fuel; preferably a petroleum hydrocarbon or biodiesel fuel; preferably a petroleum hydrocarbon; preferably crude oil, gasoline, diesel fuel, kerosene, jet fuel or heating oil; preferably gasoline or diesel fuel; preferably diesel fuel.

Preferably, the marker compounds are detected by at least partially separating them from constituents of the petroleum hydrocarbon or liquid biologically derived fuel using a chromatographic technique, e.g., gas chromatography, liquid chromatography, thin-layer chromatography, paper chromatography, adsorption chromatography, affinity chromatography, capillary electrophoresis, ion exchange and molecular exclusion chromatography. Chromatography is followed by at least one of: (i) mass spectral analysis, and (ii) FTIR. Identities of the marker compounds preferably are determined by mass spectral analysis. Preferably, the compounds are at least partially separated from the marked liquid using two-dimensional gas chromatography, preferably with different columns in the two GC separations. Preferably, mass spectral analysis is used to detect the marker compounds in the petroleum hydrocarbon or liquid biologically derived fuel without performing any separation. Alternatively, marker compounds may be concentrated prior to analysis, e.g., by distilling some of the more volatile components of a petroleum hydrocarbon or liquid biologically derived fuel.

Preferably, more than one marker compound is present. Use of multiple marker compounds facilitates incorporation into the petroleum hydrocarbon or liquid biologically derived fuel of coded information that may be used to identify the origin and other characteristics of the petroleum hydrocarbon or liquid biologically derived fuel. The code comprises the identities and relative amounts, e.g., fixed integer ratios, of the marker compounds. One, two, three or more marker compounds may be used to form the code. Marker compounds according to this invention may be combined with markers of other types, e.g., markers detected by absorption spectrometry, including those disclosed in U.S. Pat. No. 6,811,575; U.S. Pat. App. Pub. No. 2004/0250469 and EP App. Pub. No. 1,479,749. Marker compounds are placed in the petroleum hydrocarbon or liquid biologically derived fuel directly, or alternatively, placed in an additives package containing other compounds, e.g., antiwear additives for lubricants, detergents for gasoline, etc., and the additives package is added to the petroleum hydrocarbon or liquid biologically derived fuel. Use of more than one marker may be useful to avoid removal of a marker by distillation. Preferably, at least two markers are used which differ in boiling point by at least 50° C., preferably at least 75° C., preferably at least 100° C., preferably at least 125° C.

The compounds of this invention may be prepared by methods known in the art, e.g., allowing an aryloxide salt to react with an alkyl halide to form an aryl alkyl ether.

EXAMPLES

Analytical Studies

Separation of Fuel Markers from Fuel Matrix Using Single Dimensional Gas Chromatography Methodologies:

Gas Chromatography/Mass Spectrometry (GC/MS):

The GC retention times of all three dimethoxybenzene isomers, all 3 trimethoxybenzene isomers, and butyl phenyl ether were compared to that of the 50 volume % diesel distillate using the following GC columns: DB-5, DB-35, DB-210, and DB-WAX. With every column, the marker co-elutes with components in the matrix, i.e., the retention time of each candidate marker was within the retention time of the fuel matrix. Insufficient separation was obtained in each case.

Thermionic Detection (TID):

This detector is sensitive to nitrogen-containing compounds (e.g., amines and nitro compounds), and is used to detect them in the presence of non-nitrogen containing compounds. It was possible to detect all of the candidate markers in a fuel matrix at high (% level) concentrations. However, only the 1,2,4-trimethoxy benzene could be detected at levels as low as 10 ppm in the diesel distillate matrix. Nitrocyclohexane could not be detected at this level.

Separation of Fuel Markers from Fuel Matrix Using Multi-Dimensional Gas Chromatography and Mass spectrometry with Either GC-GC-MS or GC×GC-MS The ability to identify/separate 1,2-dimethoxy benzene (veratrole), 1,3,5-trimethoxy benzene, and butyl phenyl ether in ESSO Canada and FASTGAS diesel fuels was evaluated at the GC Center of Expertise Analytical Tech Center, Dow Chemical Canada.

Three methods were evaluated:

1) Conventional Two Dimensional Gas Chromatography (GC-GC/FID)
   - First dimension GC column: 30 m×0.25 mm×0.25 μm DB-5 ms UI (WCOT)
   - Second dimension GC column: 10 m×0.53 mm id CP-Lowox (Ionic sorbent/PLOT)
2) Pulsed Flow Modulated Comprehensive Two-dimensional GC (PFM-GCxGC/FID)
   - First dimension GC column: 20 m×0.18 mm×0.4 μm DB-1 (WCOT)
   - Second dimension GC column: 5 m×0.25 mm×0.15 μm HP-Innowax (WCOT)
3) Conventional Two-dimensional Gas Chromatography with MS (GC-GC/MSD in SCAN/SIM mode)
   - First dimension GC column: 15 m×0.25 mm×0.1 μm DB-1HT (WCOT)
   - Second dimension GC column: 23 m×0.25 mm×1 μm VF-Wax ms (WCOT)

While all three methods studied can separate the compounds from the matrix, the best results were obtained using method 3 which offers a high degree of selectivity and sensitivity as well as structural elucidation capability. All three of the candidates could be separated from the diesel fuel matrices, with detection limits in the 100 ppb range or better. The statistics on a preliminary data set comprising 7 analyses indicated a relative standard deviation of detection of under 4%.

D) Distillation/Detection in Fuel Distillates

A sample of diesel fuel was marked with 10 ppm butylphenyl ether, 10 ppm 1,2-dimethoxybenzene and 2.5 ppm ACCUTRACE 3,4-10 marker. The fuel was distilled in accordance with ASTM D-86 procedure, except that the distillation was stopped after 50% by volume of the initial charge had been distilled overhead. The overhead distillation temperature reached approximately 280 C by the end of the experiment. Four samples, as shown below, were analyzed for the presence/absence of the markers. Based on the boiling characteristics of the markers, we anticipate Sample C to contain the vast majority of the butylphenyl ether and 1,2-dimethoxybenzene, and essentially no ACCUTRACE 3,4-10 marker. We also anticipate Sample D to contain very little butylphenyl ether or 1,2-dimethoxybenzene, and it should contain essentially all of the ACCUTRACE 3,4-10 marker.

Sample A—Virgin diesel fuel

Sample B—Virgin diesel fuel marked with 10 ppm butylphenyl ether, 10 ppm 1,2-dimethoxybenzene, and 2.5 ppm ACCUTRACE 3,4-10 marker A 700 mL aliquot of Sample B was distilled using a variant of ASTM D-86 procedures resulting in 2 nearly equal fractions (by volume), and these are:

Sample C—overhead distillate, $1^{st}$ 50% of the volatiles

Sample D—distillate residue, $2^{nd}$ 50% of the volatiles (not taken overhead in this experiment).

When the samples were analyzed using the GC-GC/MSD in selective ion monitoring (SIM) technique, the following results were obtained:

| Analytical Results (ppm) | BPE | BPE2 | DMB | DMB2 |
|---|---|---|---|---|
| Virgin diesel (Sample A) | ND | ND | ND | ND |
| Marked diesel (Sample B) | 10.0 | 10.0 | 10.0 | 10.0 |
| 50% OVHS, distilled (Sample C) | 20.2 | 20.6 | 20.7 | 20.6 |
| Distillate residues (Sample D) | 0.1 | 0.1 | ND | ND |

BPE = Butyl Phenyl Ether
DMB = 1,2-Dimethoxybenzene
ND = not detected, detection limit: ca 50 ppb Laundering Study The study was done with fifteen laundering agents at 5% concentration, unless otherwise indicated, and 2000 mg/1 of each marker in xylenes along with 2000 mg/l squalane as an internal standard. All four molecules along with internal standard were combined and subjected to 4 hours laundering test (stirred sample with laundering agent). All laundered marker samples were analyzed by GC/FID with xylenes blank between each sample and the results reported as percent change in marker concentration. The methanol laundering study is giving an increase in concentration likely due to loss of the internal standard.

| agent | DMB | 1,4-DMB | BPE | TMB |
|---|---|---|---|---|
| 5% alumina | −20.6 | −2.4 | 0.3 | −12.9 |
| 5% NaCl | 3.8 | 11.6 | 4.2 | 0.8 |
| 5% peroxide[1] | 3.9 | 5.2 | 3.9 | 2.7 |
| 5% silica | −53.3 | −16.8 | −1.1 | −29.6 |
| 5% $CH_3CN$ | −1.0 | −1.3 | 0.6 | −1.3 |
| 5% methanol | 24.6 | 23.6 | 23.1 | 20.4 |
| 5% bleach | 5.4 | 13.3 | 4.1 | −12.3 |
| 5% fuller earth | −9.4 | −3.5 | −1. | −8.0 |
| 5% NaOH | 4.6 | 6.9 | 5.4 | 5.4 |
| 5% $H_2SO_4$ | −0.8 | 0.0 | −1.5 | −2.9 |
| 5% activated carbon | −9.6 | −6.0 | −2.9 | −9.8 |
| 50% NaOH | −7.0 | −5.1 | −2.3 | −4.2 |
| iron filings | 3.0 | 3.6 | 1.7 | 1.6 |
| molecular sieves, alumina, 60 Å | −9.1 | 6.2 | −0.2 | −5.4 |
| 98% $H_2SO_4$ | −100 | −100 | −32.7 | −100 |

TMB = 1,3,5-trimethoxybenzene;
1,4-DMB = 1,4-dimethoxybenzene
[1]5% of 30% hydrogen peroxide in water
While we did not do laundering on the hexyl-, octyl- or decylphenyl ether markers, based on chemical principles it is very likely that these will behave in a manner very close to butylphenyl ether.

Demonstration of Marker Distillation Across Diesel Fuel Boiling Range

An equimolar mixture of hexylphenyl ether, octylphenyl ether and decylphenyl ether standard was prepared via the standard Williamson ether technique. Diesel fuel was spiked with the mixture above to obtain approximately 10 ppm of each marker in the fuel. 10 ppm butylphenyl ether was added to the fuel as well.

Following the ASTM D-86 protocol modified for available laboratory equipment, the diesel fuel was then distilled into 4 fractions of approximately equal mass:

| Fraction | Boiling Range |
|---|---|
| First 25% overheads | 170-235 C. |
| $2^{nd}$ 25% overheads | 235-274 C. |
| $3^{rd}$ 25% overheads | 274-303 C. |
| Pot residue | >303 C. |

These 4 fuel samples were then analyzed using a GC-GC-FID technique. The peak areas for each marker were normalized to 100%, and the relative amount of marker appearing in the various fractions was calculated. The results are collected in the table:

| Fraction # | butylphenyl ether BP = 210 C. | hexylphenyl ether BP = 240 C. | octylphenyl ether BP = 285 C. | decylphenyl ether BP = 318 C. |
|---|---|---|---|---|
| Fraction 1 | 62.4% | 25.2% | 9.3% | ND |
| Fraction 2 | 35.9% | 49.6% | 28.5% | 29.3% |
| Fraction 3 | 1.7% | 24.4% | 46.4% | 32.3% |
| Pot Residue | ND | 0.8% | 15.9% | 38.4% |

ND means <50 ppb

As can be seen from the data, both hexylphenyl ether and octylphenyl ether were clearly present in all fractions. Butylphenyl ether had been completely removed from the pot residue (bottoms) and the decylphenyl ether did not distill into the lightest fraction. Thus any one of the butyl-, hexyl- and octylphenyl ethers could be added to diesel fuel, along with ACCUTRACE 3,4-6 or 10, and all distillation fractions could be identified as containing our marker system. Alternately, either hexyl- or octylphenyl ether could be added to diesel fuel (in the absence of ACCUTRACE) and all possible distillation fractions could still be identified as being marked.

The invention claimed is:

1. A method for marking a petroleum hydrocarbon or a liquid biologically derived fuel; said method comprising adding to said petroleum hydrocarbon or liquid biologically derived fuel at least one compound having formula (I)

(I)

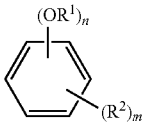

wherein $R^1$ is $C_1$-$C_{12}$ alkyl or $C_2$-$C_{12}$ alkenyl, $R^2$ is $C_1$-$C_{12}$ alkyl or $C_3$-$C_{12}$ alkenyl, m is an integer from zero to five and n is an integer from one to three; wherein each compound of formula (I) is present at a level from 0.01 ppm to 100 ppm.

2. The method of claim 1 in which m is zero to two.

3. The method of claim 2 in which $R^2$ is $C_1$-$C_6$ alkyl.

4. The method of claim 3 in which n is one.

5. The method of claim 4 in which m is zero or one, and $R^2$ is $C_1$-$C_4$ alkyl.

6. The method of claim 5 in which each compound of formula (I) is present at a level from 0.05 ppm to 50 ppm.

7. The method of claim 3 in which n is two or three, $R^1$ is methyl, $R^2$ is methyl and m is zero or one.

8. The method of claim 7 in which $R^1$ is methyl and m is zero.

9. The method of claim 8 in which each compound of formula (I) is present at a level from 0.05 ppm to 50 ppm.

10. The method of claim 1 in which m is zero, n is one and $R^1$ is $C_4$-$C_{12}$ alkyl or $C_4$-$C_{12}$ alkenyl.

11. The method of claim 10 in which $R^1$ is $C_4$-$C_{12}$ alkyl.

12. The method of claim 11 in which $R^1$ is $C_4$-$C_{10}$ alkyl.

* * * * *